US010919548B2

(12) United States Patent
Malik

(10) Patent No.: US 10,919,548 B2
(45) Date of Patent: Feb. 16, 2021

(54) NON-STOP TRAIN WITH ATTACHING AND DETACHING TRAIN CARS

(71) Applicant: Mohd B. Malik, Old Lyme, CT (US)

(72) Inventor: Mohd B. Malik, Old Lyme, CT (US)

( * ) Notice: Subject to any disclaimer, the term of this patent is extended or adjusted under 35 U.S.C. 154(b) by 0 days.

(21) Appl. No.: 16/105,457

(22) Filed: Aug. 20, 2018

(65) Prior Publication Data

US 2020/0055530 A1 Feb. 20, 2020

(51) Int. Cl.

| | |
|---|---|
| ***B61L 3/16*** | (2006.01) |
| ***B61L 3/12*** | (2006.01) |
| ***B61L 15/00*** | (2006.01) |
| ***B61B 13/00*** | (2006.01) |

(52) U.S. Cl.

CPC ..... *B61L 3/16* (2013.01); *B61B 13/00* (2013.01); *B61L 3/126* (2013.01); *B61L 15/0027* (2013.01); *B61L 15/0054* (2013.01); *B61L 15/0072* (2013.01)

(58) Field of Classification Search

CPC ..... B61L 3/16; B61L 3/126

See application file for complete search history.

(56) References Cited

U.S. PATENT DOCUMENTS

| | | | | |
|---|---|---|---|---|
| 3,037,462 | A | | 6/1962 | Barry et al. |
| 3,508,496 | A | | 4/1970 | Larson et al. |
| 3,519,805 | A | | 7/1970 | Thorne-booth et al. |
| 3,552,321 | A | | 1/1971 | Priebe et al. |
| 3,650,216 | A | | 3/1972 | Harwick et al. |
| 3,728,974 | A | | 4/1973 | Lashley |
| 3,848,533 | A | * | 11/1974 | Grow ..... B61K 1/00 104/18 |
| 4,042,810 | A | * | 8/1977 | Mosher ..... G09B 9/04 701/19 |
| 4,202,454 | A | | 5/1980 | Browne et al. |
| 4,207,569 | A | | 6/1980 | Meyer |
| 4,217,643 | A | | 8/1980 | Anderson et al. |
| 4,235,402 | A | | 11/1980 | Matty et al. |
| 4,361,300 | A | | 11/1982 | Rush |
| 4,561,057 | A | | 12/1985 | Haley, Jr. et al. |
| 4,582,280 | A | | 4/1986 | Nichols et al. |
| 4,702,291 | A | | 10/1987 | Engle |

(Continued)

OTHER PUBLICATIONS

International Search Report and Written Opinion; PCT/US19/46267; dated Feb. 14, 2020.

*Primary Examiner* — Nicholas K Wiltey
*Assistant Examiner* — Tiffany K Luu
(74) *Attorney, Agent, or Firm* — Kilyk & Bowersox, P.L.L.C.

(57) ABSTRACT

A non-stop train system including a plurality of train cars in communication with one another and in communication with an electronic control module. The train system further includes a track having a plurality of drop off and pick up locations. A prepositioned train car is stopped on the track at one of the drop off and pick up locations. A non-stop express train approaches the drop off and pick up location on the track initiating the prepositioned train car to begin departure. The electronic control module is used to adjust the speed of the non-stop express train and the prepositioned train car based on a detected distance such that a front coupler of the non-stop express train couples to the rear coupler of the prepositioned train car while moving along the track.

14 Claims, 16 Drawing Sheets

(56) References Cited

U.S. PATENT DOCUMENTS 4,774,669 A 9/1988 Schmitz et al.
4,781,119 A 11/1988 Davis
5,010,614 A 4/1991 Braemert et al.
5,031,544 A 7/1991 Braemert et al.
5,053,964 A 10/1991 Mister et al.
5,168,815 A 12/1992 Comer et al.
5,374,015 A 12/1994 Bezos et al.
5,398,894 A 3/1995 Pascoe
5,420,883 A 5/1995 Swensen et al.
5,429,329 A 7/1995 Wallace et al.
5,452,870 A 9/1995 Heggestad
5,647,562 A 7/1997 Lumbis et al.
5,697,583 A 12/1997 Kane
5,785,283 A 7/1998 Ehrenberger et al.
5,797,330 A 8/1998 Li
5,813,635 A * 9/1998 Fernandez ..... B61L 15/0027 246/168
5,924,774 A 7/1999 Cook et al.
6,029,104 A 2/2000 Kim
6,095,618 A 8/2000 Heneka et al.
6,321,657 B1 11/2001 Owen
6,401,015 B1 6/2002 Stewart et al.
6,418,854 B1 7/2002 Kraft
6,434,452 B1 8/2002 Gray
6,580,976 B1 6/2003 Belcea
6,591,758 B2 7/2003 Kumar
6,615,118 B2 9/2003 Kumar
6,732,023 B2 5/2004 Sugita et al.
6,830,224 B2 12/2004 Lewin et al.
6,865,454 B2 3/2005 Kane et al.
6,984,946 B2 1/2006 Donnelly et al.
7,304,445 B2 12/2007 Donnelly
7,430,967 B2 10/2008 Kumar
7,565,867 B2 7/2009 Donnelly et al.
7,748,549 B1 7/2010 Browning
7,966,126 B2 6/2011 Willis et al.
8,428,798 B2 4/2013 Kull
8,676,466 B2 3/2014 Mudalige
9,022,325 B2 5/2015 Tsukamoto
2003/0209638 A1 11/2003 Peltz
2005/0039629 A1 2/2005 Mayer et al.
2007/0272115 A1* 11/2007 Mayer ..... B61K 1/00 104/20
2010/0275810 A1 11/2010 Barbee et al.
2011/0172856 A1* 7/2011 Kull ..... B61L 15/0027 701/19
2011/0285842 A1 11/2011 Davenport et al.
2013/0153714 A1 6/2013 Qu et al.
2013/0171590 A1 7/2013 Kumar
2013/0196519 A1* 8/2013 Krause ..... B61G 5/10 439/34
2014/0125795 A1* 5/2014 Yerke ..... B60R 1/00 348/118
2016/0362123 A1* 12/2016 Schultz ..... B61L 25/025
2018/0079436 A1* 3/2018 Fifield ..... B61L 27/0027

* cited by examiner

Prior Art

*Distance sensors can be any or all of the following: Radio Frequency (Radar), Sound (Sonar) Ultrasonic, Visual (Cameras, Computer Generated Images, Digital Graphical Inputs)

NON-STOP TRAIN WITH ATTACHING AND DETACHING TRAIN CARS

BACKGROUND OF THE INVENTION

The present invention relates to a train system and, more particularly, to a non-stop train system with attaching and detaching train cars for unloading and loading passengers.

Currently, the method for operating train and mass transit rail systems is for a train to stop at each pre-existing station along a predetermined route to board and discharge passengers. The slowing down, stopping and waiting at each pre-existing station and then accelerating away from each station consume a lot of time, energy and reduce the efficiency of the overall operating system.

Many methods have been proposed and even incorporated to try and reduce the delays caused by this outmoded method of operation, such as electronic ticketing, adding more trains, reducing the number of stops during rush hour periods and reducing the time at each stop. None of these approaches meet the often-conflicting goals of improving service, reducing wait times, decreasing operating and maintenance costs while increasing the average train speed to get riders where they want to go as quickly as possible.

Recent developments in the mass transit art include trains running in vacuum conditions inside sealed tunnels to increase travel speeds. These tunnels are dug by special boring machines that operate without disturbing surface or sub-surface infrastructure. Another proposal is to install monorail systems along highway routes to reduce new transit line construction costs. A Chinese mass transit train design proposal has train cars with detachable passenger cars above the main cars. The passenger cars detach and travel on a separate set of tracks to each station and then return to the main track to reattach to the main cars. All these ideas are novel and are certainly within the realm of possibilities, but are enormously costly to implement.

These expensive improvements aside, the current mass transit art has not kept pace with the need for faster service and more convenient schedules for the current ridership. It has also not sought to have well-equipped train cars with toilets, cafes or wireless internet access that is demanded by passengers of transit systems in the present day. These and other conveniences are required to retain the present ridership and to attract new ridership in an era where the trend is to ride-share, use a smart phone to summon call-for-hire rides and, in general, avoid vehicle ownership. As an example of this shortsightedness in the current art, rapid transit rail cars currently in service or being ordered by large mass transit systems do not have any provision for these features or amenities. However, they must be considered necessary in today's convenience-driven and technology-driven environment.

The San Francisco Bay Area Rapid Transit (BART) system and the Los Angeles and Washington D.C. Metro systems are modern and provide relatively comfortable service. However, they could be improved by offering higher average travel speed and more frequent arrival and departure schedules. There are other urban city mass transit systems in the United States that are still using outmoded and/or decaying rail cars and are not catering to the needs of their ridership in either conveniences or travel schedules. Known plans of the New York City Metropolitan Transportation Authority (MTA) to replace existing rail cars with new R211 rail cars are still circumscribed by use of the current, outdated and inflexible operating system that has not changed in its basic operational methods in over 100 years of service.

As can be seen, there is a need for a train system with higher average train speeds, convenient schedules to suit the ridership, decreased operating costs with less wear and tear on the equipment, and the incorporation of various amenities on the rail cars to make rapid transit via rail more enjoyable for the ridership with a minimal required capital investment in equipment.

SUMMARY OF THE INVENTION

In one aspect of the present invention, a non-stop train system comprises: a plurality of train cars each comprising: a braking system coupled to rail wheels; an operators cab comprising controllers; a front coupler and a rear coupler; a proximity sensor; and a wireless transmitter and receiver, an electronic control module communicatively coupled to the proximity sensor via the wireless transmitter and receiver and comprising a processor and a memory, and a track comprising a plurality of drop off and pick up locations, wherein at least one prepositioned train car of the plurality of train cars is stopped on the track at one of the plurality drop off and pick up locations, at least one non-stop express train car of the plurality of train cars approaches the one of the plurality drop off and pick up locations on the track initiating the at least one prepositioned train car to begin departure from the one of the plurality drop off and pick up locations, the sensors detect a distance and a relative speed between the at least one non-stop express train car and the at least one prepositioned train car, and the electronic control module adjusts the speed of the at least one non-stop express train car and the at least one prepositioned train car based on the detected distance such that the front coupler of the at least one non-stop express train car couples to the rear coupler of the at least one prepositioned train car while moving along the track.

In another aspect of the present invention, a non-stop train system comprises: a plurality of train cars each comprising: a braking system coupled to rail wheels; an operators cab comprising controllers; a display disposed within the operator's cab; a front coupler and a rear coupler; a proximity sensor; and a wireless transmitter and receiver; an electronic control module communicatively coupled to the proximity sensor and the display via the wireless transmitter and receiver, and comprising a processor and a memory, and a track comprising a plurality of drop off and pick up locations, wherein at least one prepositioned train car of the plurality of train cars is stopped on the track at one of the plurality drop off and pick up locations, at least one non-stop express train car of the plurality of train cars approaches the one of the plurality drop off and pick up locations on the track initiating the at least one prepositioned train car to begin departure from the one of the plurality drop off and pick up locations, the sensors detect a distance and a relative speed between the at least one non-stop express train car and the at least one prepositioned train car, and the electronic control module processes inputs of the proximity sensors and outputs data comprising the distance and the relative speed between the at least one non-stop express train car and the at least one prepositioned train car on the display to facilitate the coupling of the front coupler of the at least one non-stop express train car to the rear coupler of the at least one prepositioned train car while moving along the track.

These and other features, aspects and advantages of the present invention will become better understood with reference to the following drawings, description and claims.

DETAILED DESCRIPTION OF THE INVENTION

Figure 1:
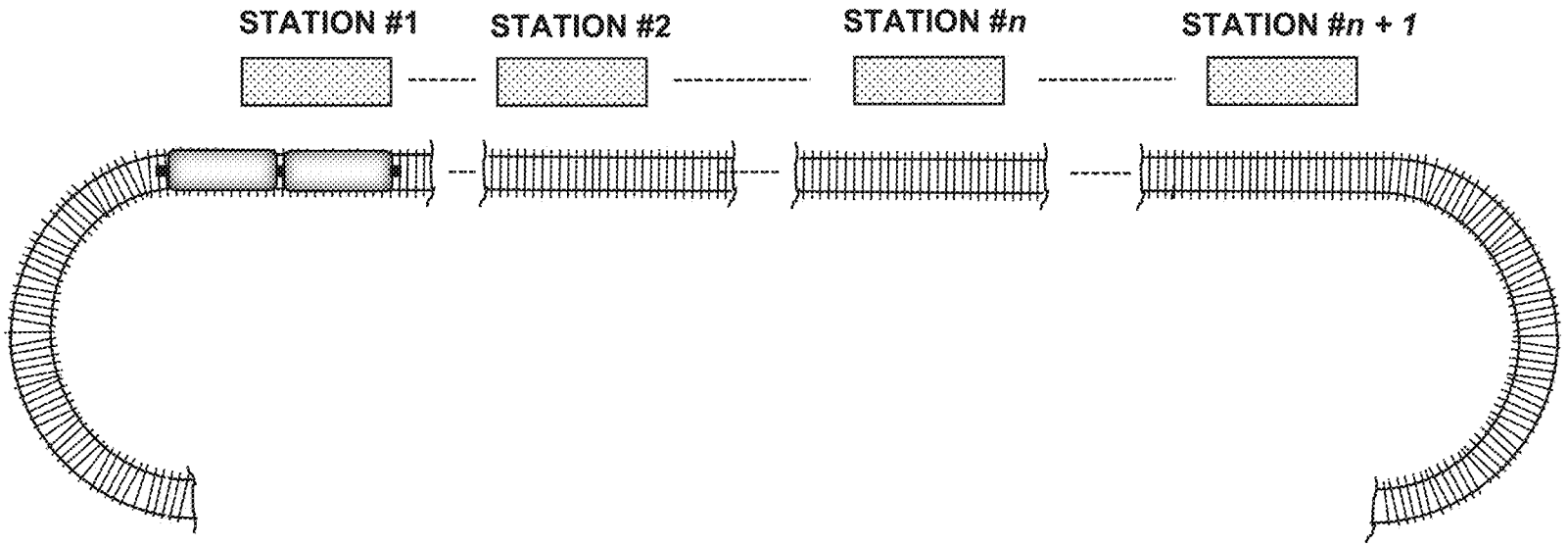
FIG. 1 is a schematic diagram in plan view of a typical train track with station stops along the route.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention encompasses autonomous, self-driving or manually operated, self-propelled non-stop trains carrying passengers, cargo, baggage, or any combination of these items, that travel on train tracks or a similar predetermined route with train cars that attach at the front of the non-stop train and with individual, or multiple, train cars that detach at the rear of the non-stop train.

Attachment and detachment of the train cars may be by way of the standard Scharfenberg coupler, a coupling mechanism that allows for these connections to be made and unmade while the non-stop trains and individual train cars are underway. A coupling proximity sensor suite system, added as part of the present invention, is used to provide all of the operational enhancements required to put the present invention into operation. The coupling proximity sensor suite system is designed to be modularized such that it can easily be retrofitted to either existing train cars or can be incorporated into new cars under construction.

Individual train cars are prepositioned at either existing stations or at any location along the route and then leave each stop or station ahead of the non-stop train that is approaching. Leading car of the non-stop train couples underway with the coupling mechanism at the rear of the prepositioned train car that just left the station. Subsequent to this operation, the underway, non-stop train detaches the last train car or cars from the non-stop train and that detached train car or cars slow down and stop at the station that the train car that coupled to the front of the non-stop train just left from. The operator of the newly attached front car transits through the train to the operator cab of the last car, which detaches shortly, while the main train operator moves from the previously front car of the non-stop train to the newly attached front car, which is now the main car of the non-stop train.

Coupling and decoupling control of the train cars is transferred to the newly attached front car, or any car in the non-stop train, via the master key, master token, master code card or some other similar device that is part of the coupling proximity sensor suite system.

Passengers wait safely inside the previously prepositioned train car or cars at each station or location out of the weather and environmentally comfortable until the train car leaves the station or location ahead of the next approaching non-stop train. These prepositioned cars are cleaned, amenities, such as water, snacks, beverages are restocked and batteries, if used, are recharged while waiting.

Passengers already on the non-stop train that are getting off at the next station or location stop are instructed by audio and visual signals as well as the conductor-operator to move to the rear car of the non-stop train prior to the access doors closing and that train car then detaches and stops at the next station or location stop.

The non-stop train and individual train cars are self-propelled and either controlled by a human operator with computer assistance or are automatically controlled by computer mechanisms that interface with the coupling proximity sensor suite system.

FIG. 1 depicts a typical train track system for mass transit or rapid transit operations that uses one or more tracks for routing of train cars and has multiple stations, along the track. Stations are shown along the route of each track to allow for embarking and disembarking of passengers. Typically, in the art, trains run on each track in one direction and stop at each station for passengers along the entire length of that particular route and then follow a loop to turn around to head back using another parallel track.

Figure 2:
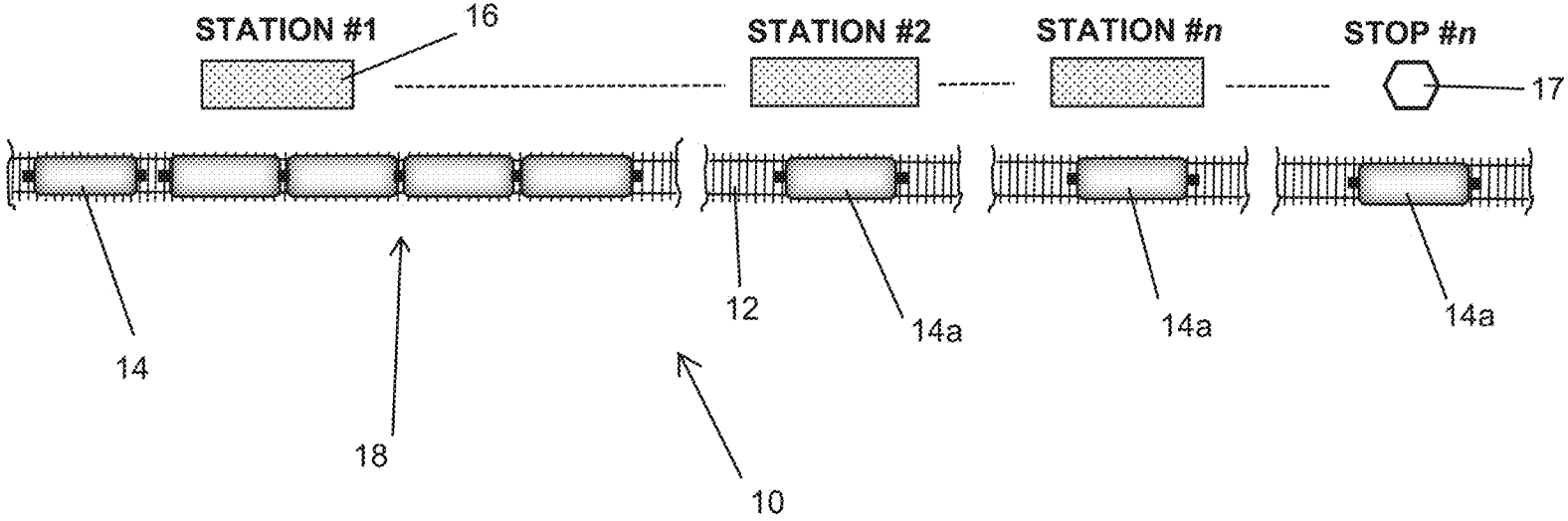
FIG. 2 is a schematic diagram in plan view of an embodiment of the present invention illustrating the initial positioning of the express train at the first station or stop and the prepositioned train cars located at each station or stop along the route that wait for passengers prior to arrival of the non-stop express train.

FIG. 2 depicts a non-stop train system 10 of the present invention that includes a non-stop express train 18. The non-stop express train 18 runs on the same track 12 in either direction and does not have to turn around or cross over to another track 12 to operate. A prepositioned express train car 14*a* or cars 14*a*, depending on passenger volume, are stationed at each drop off and pickup location 16, 17 along the existing route. This embodiment has the flexibility to allow for prepositioned express cars 14*a* to be anywhere along the route without the requirement to use pre-existing stations 16. Each prepositioned train car 14*a* may uniquely act as a drop off and pickup location 16, 17 anywhere along the track 12 with a safe, climate-controlled environment and with the options of wireless internet access, toilet facilities and food and beverage kiosks. Each prepositioned train car 14*a* has an operator who acts as the conductor while the car is stationary awaiting the non-stop express train 18. The conductor monitors the prepositioned train car 14*a* to ensure passengers are safe. The operator may use a hand-held scanning device, such as used for bar codes, to scan each passenger's ticket to confirm payment. Once all passengers are accounted for and via audio and visual in-car signals, the arrival of the non-stop express train 18 is announced, the access doors on the sides or ends of the prepositioned car 14*a* close and the conductor then becomes the operator and enters the operator's cab and prepares to leave the drop off and pickup locations 16, 17 in advance of the on-coming express train 18. Each operator's cab as part of this embodiment, contains a visual display, part of a coupling proximity sensor suite system, indicating the distance and time of arrival of the non-stop express train 18 that is approaching from behind the prepositioned car 14*a* and an audio and visual countdown to accelerate the prepositioned car 14*a* to speed in advance of the non-stop train's arrival. The operators of the prepositioned car 14*a* and the non-stop express train 18 are in constant communication via transmitters and receivers over wireless networks to ensure coordination of train operations.

Figure 3A:
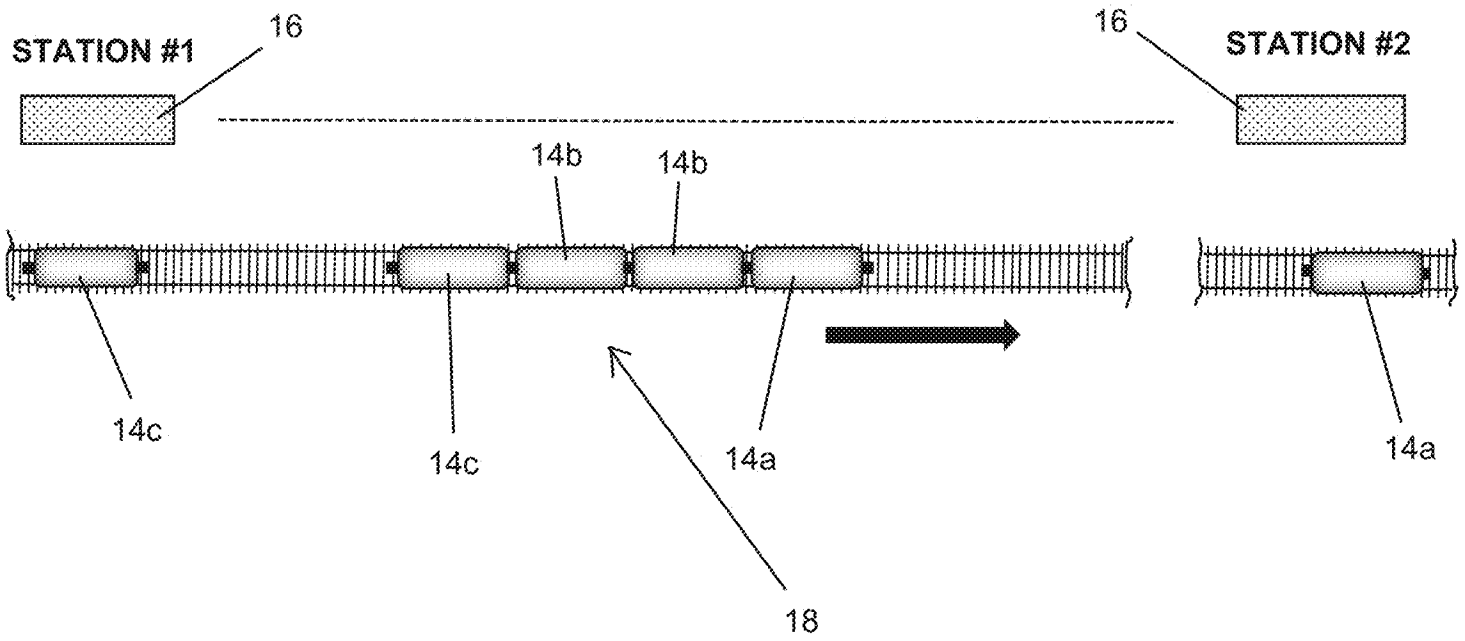
FIG. 3A is a schematic diagram illustrating the movement of the express train leaving the first station or stop and proceeding to the next station or stop and a non-attached train car or cars, depending on passenger volume requirements, that remains at the first station or stop as a prepositioned car.
Figure 3B:
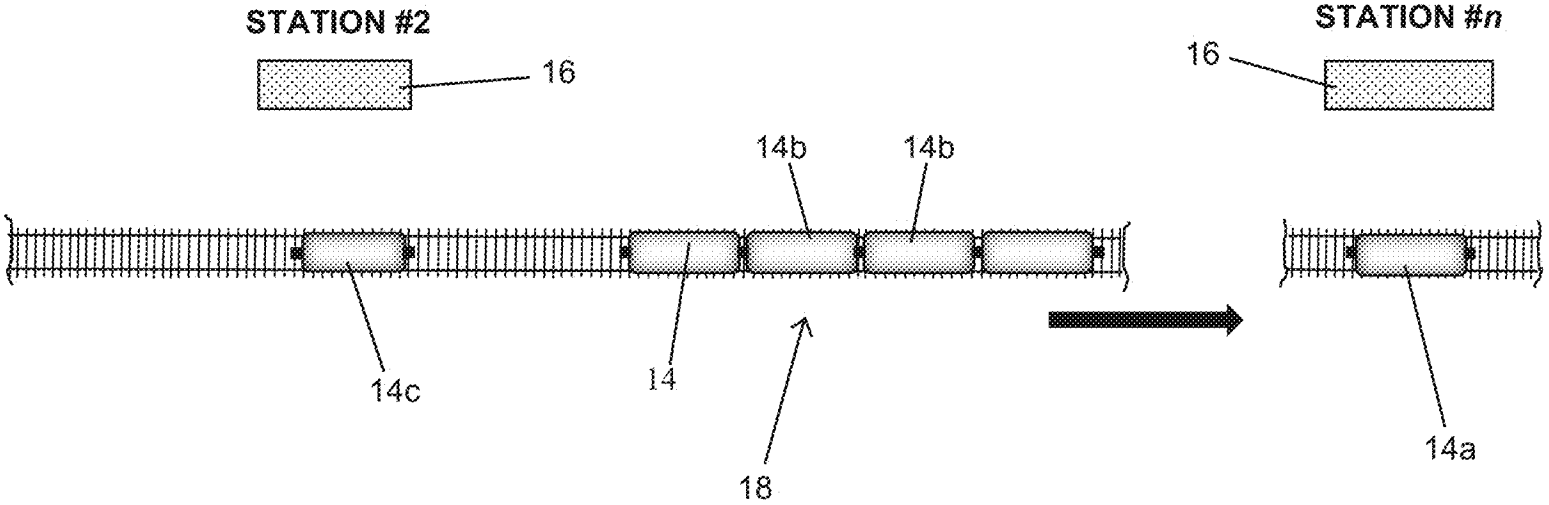
FIG. 3B is a schematic diagram illustrating the train car decoupled from the express train and slowing down to come to a stop at the aforementioned station and is the prepositioned car at that station.

FIGS. 3A and 3B depict the basic operating cycle of this embodiment wherein the prepositioned train car 14*a* accelerates to operating speed upon approach of the non-stop express train 18 and the last car 14 or cars 14, i.e. the drop off car(s) 14*c*, that are attached to the non-stop express train 18 remain attached to the non-stop express train 18 until the prepositioned car operator arrives to begin the decoupling process to allow the drop off car(s) 14*c* to detach and stop at the designated station 16 or stop that the propositioned car 14*a* that just accelerated away from, has left. The drop off cars 14*c* that are approaching this aforementioned station 16 or stop are expected to decelerate and by using braking or, in a further embodiment, using regenerative braking, come to a stop to act as the replacement propositioned car 14*a* at this the designated station 16 or stop. At the originating point of the non-stop express train 18, which is the first station 16 or stop on the route, the present invention may include two trains 18 at the originating point that are not connected to each other and are on the same tracks: one is the non-stop express train 18 that includes a variable number of non-stop express cars 14*b*, depending on passenger volume requirements, and is ahead of the other train 18. The other train 18, which is behind the non-stop train 18 on the same track, but is not coupled to it, includes one or more cars 14, depending on passenger volume demands, and is the prepositioned car 14*a* that remains at the initial station 16 or stop to await the return of the non-stop express train 18.

Figure 4:
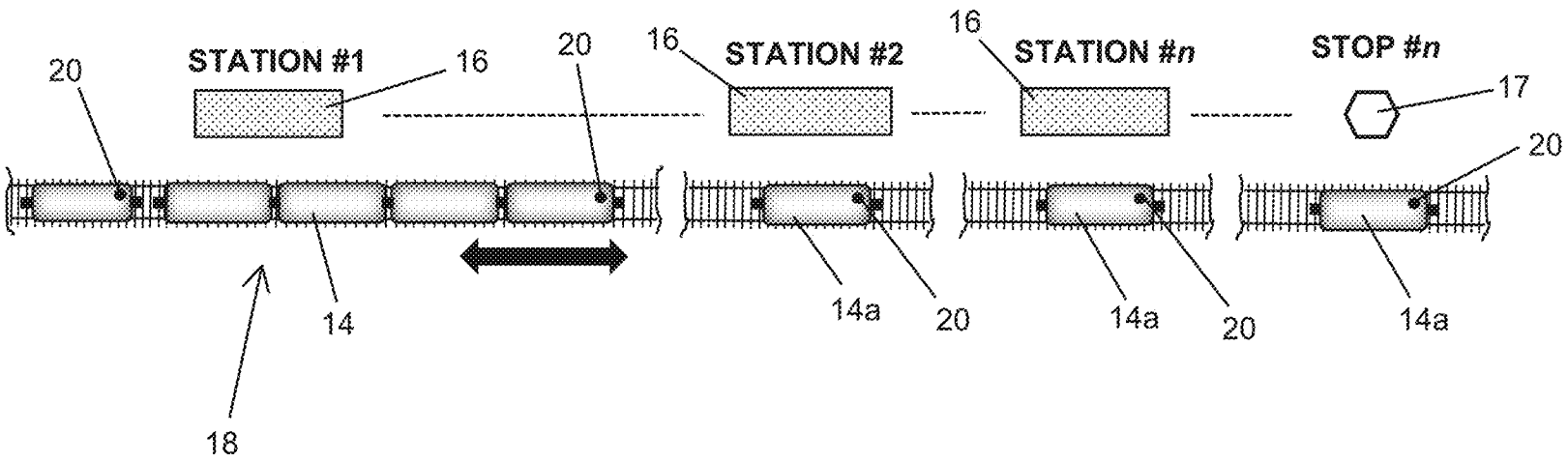
FIG. 4 is a plan view of an embodiment of the present invention illustrating the express train interior depicting the initial positioning of the train car operators at the first station or stop.

FIG. 4 depicts the interior plan view showing the initial positioning of the train car operators 20 of both the non-stop express train cars 14 and the prepositioned train car 14 that are at the station 16 or stop 17. It also depicts the interior plan view of the downstream prepositioned train cars 14*a* showing the initial positioning of the train car operators 20 at the successive station 16 or stop 17 along the route. The express train embodiment includes fully manual operation, manual operation with computer assistance and fully automated, computer-controlled operation of both the non-stop express trains 18 and the prepositioned train cars 14 via the coupling proximity sensor suite system. The type of operation is determined by the desired speed of the trains 18, complexity of the routes and the funding available to upfit the existing rail cars 14 with the necessary system and computer hardware. New rail cars 14 can have the desired coupling proximity sensor suite system controls incorporated during construction. The coupling proximity sensor suite system is further described below.

Figure 5:
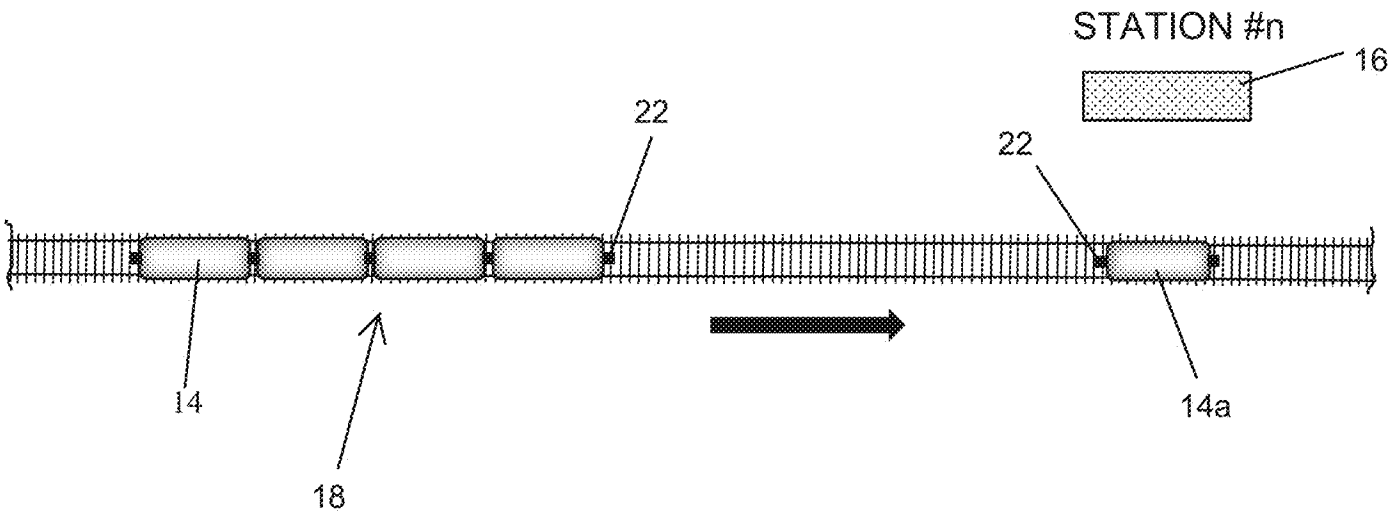
FIG. 5 is a schematic diagram in plan view of an embodiment of the present invention illustrating the express train approaching the next station or stop and the prepositioned train car at that station or stop leaving the station or stop ahead of the express train's arrival.

FIG. 5 is a depiction of the operation of the non-stop express train 18 approaching the next station 16 or stop along the route after it leaves either the origination point or any station 16 or stop along the way and shows that the prepositioned train car 14*a* at that the station 16 or stop is leaving the station 16 or stop ahead of the express train's arrival. This evolution, again, is coordinated between the operator of the non-stop express train 18 and the operator of the prepositioned car 14*a* via constant wireless network communication and the coupling proximity sensor suite system to ensure safe and efficient operation of the trains 18. The embodiment includes the use of a coupling proximity sensor suite, which is described in more detail below, to allow for a smooth and safe coupling of the mating trains 18 while continuing to use the current art and industry standard Scharfenberg couplers 22 already installed on existing and new train cars 14.

Figure 6:
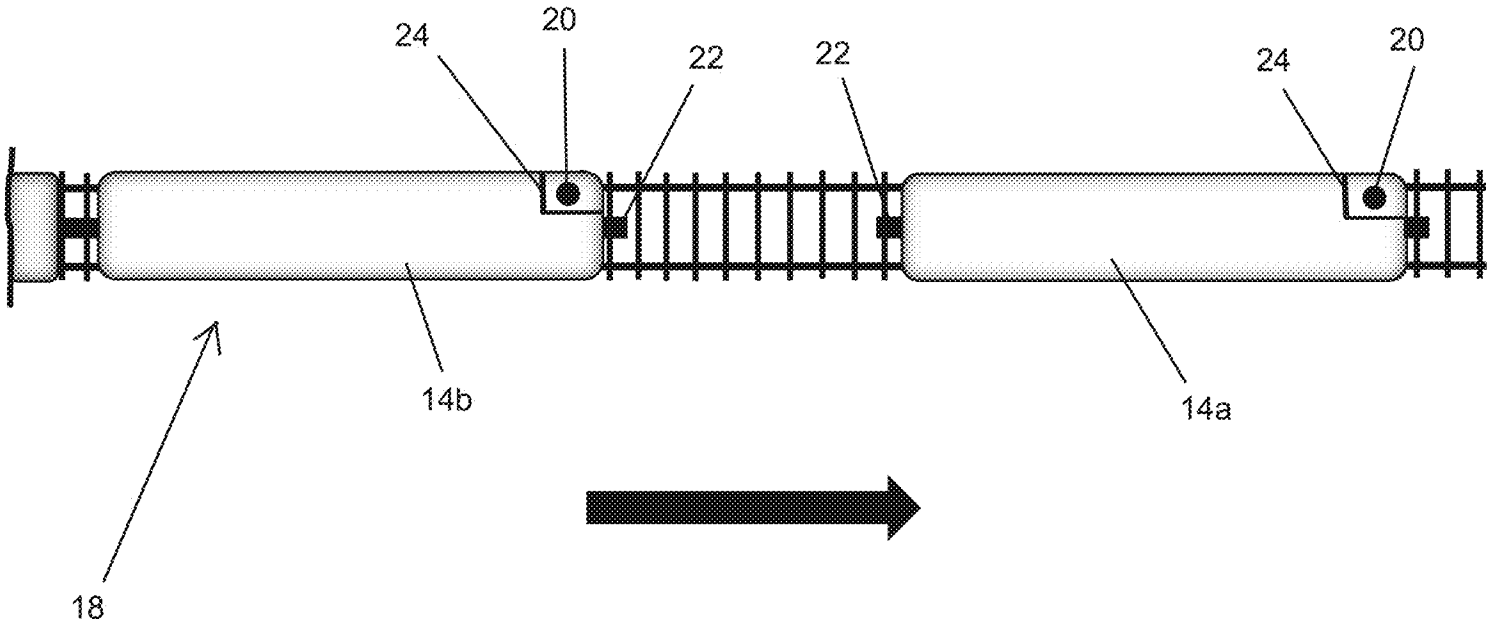
FIG. 6 is a plan view of an embodiment of the present invention illustrating the positioning of the express train operator and the positioning of the operator of the train car that just left the station or stop ahead of the express train prior to coupling of the two trains together.

FIG. 6 depicts the positioning of the non-stop express train operator 20 and the positioning of the operator 20 of the prepositioned train car 14*a* that just left the station or stop ahead of the non-stop express train 18. This scenario is prior to coupling of the prepositioned car 14*a* to the front non-stop express car 14*b* of the non-stop express train 18. These operators 20 are either fully manually controlling or using partial computer control or fully computerized control of the acceleration, approach, coupling and control transfer to the prepositioned car 14*a*, which is the car 14*a* that just attached to the front of the non-stop express train 18. Prior to transfer of control to the prepositioned car 14*a* that will soon be the lead car 14*b* of the non-stop express train 18, the operator 20 of the non-stop express train 18 remains in the operator's cab 24 and monitors the visual indicators that display the status of upcoming coupling operation and the speeds of the train cars 14 and is in constant communication with the operator 20 of the prepositioned car 14 ahead. The operator 20 of the prepositioned car 14 is also monitoring the indicators for train speed and operational status of the couplings 22 and controls of the prepositioned car 14 using the displays in the operating cab 24 of the train car 14. The coupling proximity sensor suite system is used for these operations.

Figure 7:
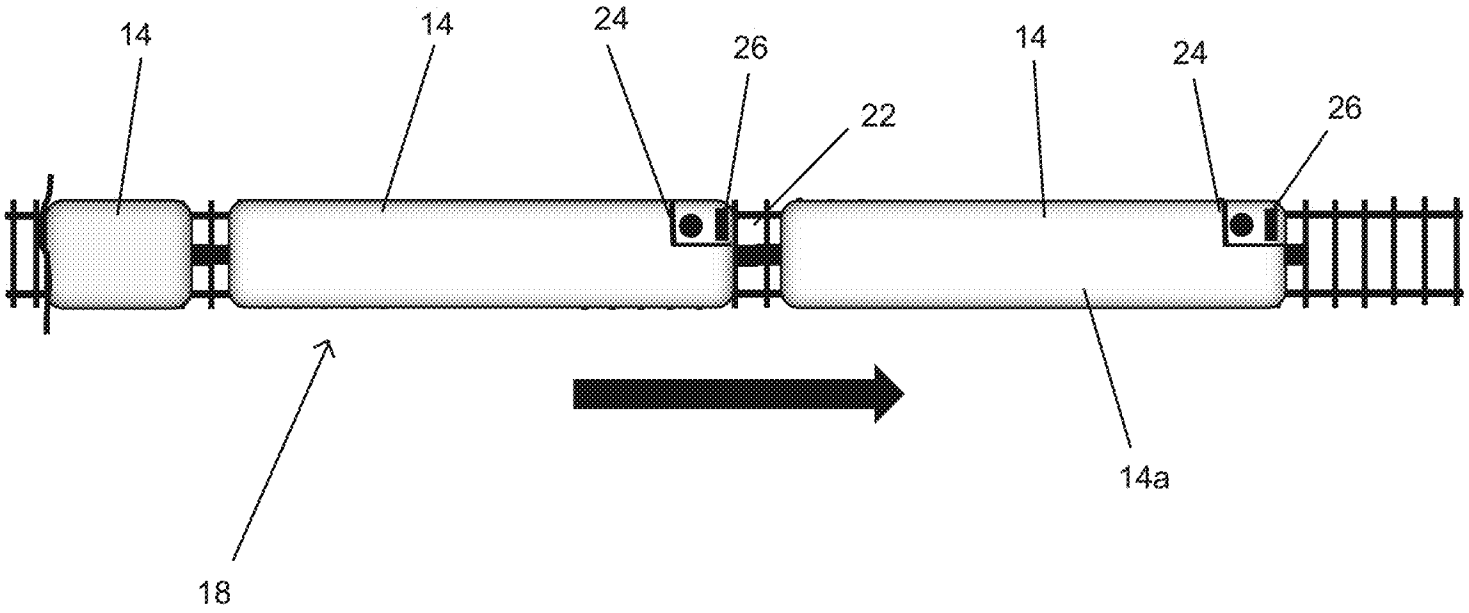
FIG. 7 is a plan view of an embodiment of the present invention illustrating the coupling operation of the prepositioned car and the non-stop express train while underway at speed.

FIG. 7 depicts the actual coupling operation of the prepositioned car 14 that previously left the station or stop and is going to be attaching to the lead car 14 of the non-stop express train 18 approaching from behind. The coupling of the prepositioned car 14*a* and the non-stop express train 18 while underway at speed uses the existing Scharfenberg coupling 22 on each car 14, supplemented by the coupling proximity sensor suite system and the associated displays 26 in the connecting cars 14 to aid in safe, coordinated and smooth coupling of the two cars 14 together. The embodiment covers the use of a fully manual, computer-assisted or fully automated coupling proximity sensor suite system to control this coupling evolution while underway. This embodiment acknowledges the suitability of the Scharfenberg coupling 22 because it is designed to couple together while the two train cars so equipped are moving at a minimum differential velocity of 0.6 km per hour (0.37 miles per hour) up to a maximum differential speed of 22 miles per hour. The Scharfenberg coupling 22 can only connect the rail cars 14 together if at least one of the two train cars 14 is moving. The embodiment uses a common coupling proximity sensor suite system display 26 in the operator cabs 24 of each car 14 to provide the necessary information, instructions, status, warnings and error messages to be used during the actual coupling evolution. This display 26 is the same regardless of whether the coupling operation is fully manual, partially computer-controlled, or a fully automated system. The display 26 shows the coupling status information, confirmation that the cars are properly connected together or any error message or messages with corresponding operator action or actions required to correct.

Figure 8:
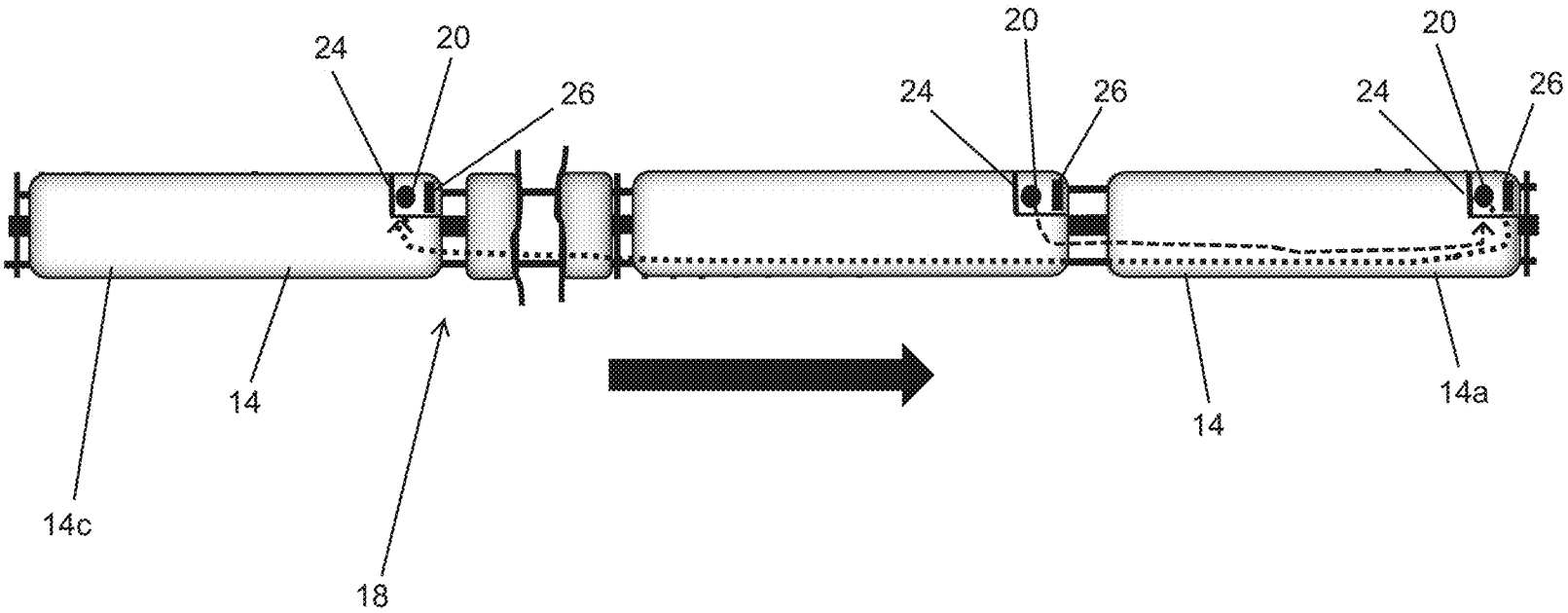
FIG. 8 is a plan view of an embodiment of the present invention illustrating the movement of the express train operator to the cab of the train car that just attached to the front of the express train and the movement of the operator of the front car that just attached on their way to the last car on the express train that is going to detach for the station or stop that is now being passed.

FIG. 8 depicts the movement of the express train operator 20 forward to the operator cab 24 of the train car 14 that just attached to the front of the express train 18 and the movement of the operator 20 of the front car 14 that just attached going rearwards to the last car 14 on the express train 18 that is set to detach at the drop off and pickup location that is now being passed. As part of the transfer of control to the lead car 14, the operator of the non-stop express train 18 is still in the operator's cab 24 and is monitoring the visual indicators of the coupling proximity sensor suite system that displays the status of the coupling operation and the completion of the control transfer to the leading car 14. The operator 20 of the prepositioned car 14*a* that is now coupled to the front of the non-stop express train 18 and is now acting as the lead car 14, also monitors the coupling proximity sensor suite system visual display 26 in that operator's cab 24 and once coupling and control transfer is confirmed on the display 26, the operator 20 of the non-stop express train 18 removes the master operating key, master token, master code card or other similar device from the coupling proximity sensor suite system in the cab 24 and travels forward through the train 18 to the operator's cab 24 of the now leading car 14. Once there, the prepositioned car operator 20 leaves the cab 24, takes the master operating key, master token, master code card or other similar device from the other operator 20 and moves down to the drop off car 14*c* or, depending on passenger volume, the leading car of a multiple set of drop off cars 14*c* and enters the operator's cab 24 of that leading car 14, inserts the master key, master token, master code card or other similar device into that cab's 24 coupling proximity sensor suite system display 26 and confirms that the drop off car 14 is ready to decouple and operate independently. The embodiment coupling proximity sensor suite system display 26 is also equipped to provide confirmation that the transfer of control is complete or to show any error message or messages and the action or actions required to correct.

Figure 9:
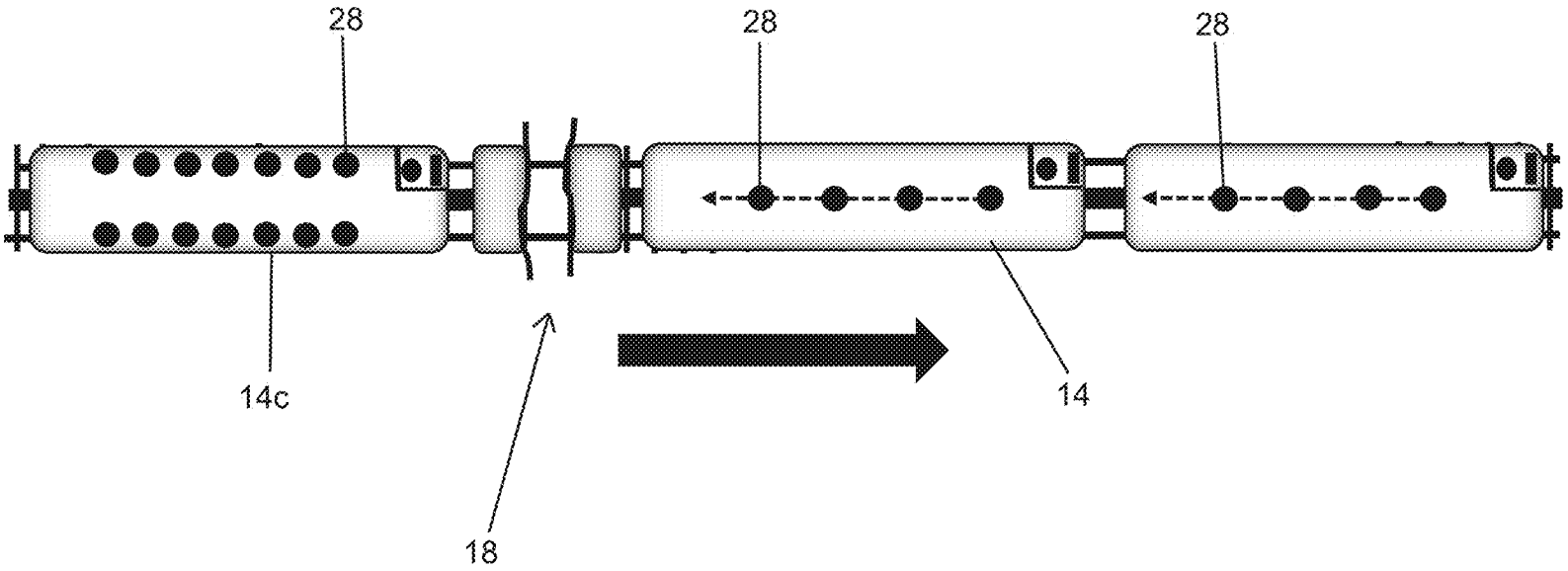
FIG. 9 is a plan view of an embodiment of the present invention illustrating the movement of passengers to the last car of the train prior to departure of the last car for the station or stop that is now being passed.

FIG. 9 depicts the movement of passengers 28 to the drop off car 14*c* of the train 18 prior to departure of the drop off car 14*c* for the station or stop that is coming up. While this Figure shows one drop off car 14*c*, this embodiment covers the potential that multiple drop off cars 14*c* may be used depending on passenger 28 volume requirements at each station or stop. Passengers 28 are instructed by audible signals and visual signboard indicators with the drop off and pickup location information and arrows showing which direction to go in order to be in the correct car 14 prior to disembarkation. No matter where the passengers 28 are in the train 18, these signals, station information and travel direction arrows are prominently displayed. A further embodiment is that those passengers 28 that sign up to receive text message alerts from the transit authority receive notifications on their phone or other smart device when they should move to the drop off car 14*c* and which car 14 to be in in order to disembark at the desired station or stop. Those passengers 28 with hearing or visual impairment can receive instructions via vibration of their personal devices or via their braille-equipped devices.

Figure 10:
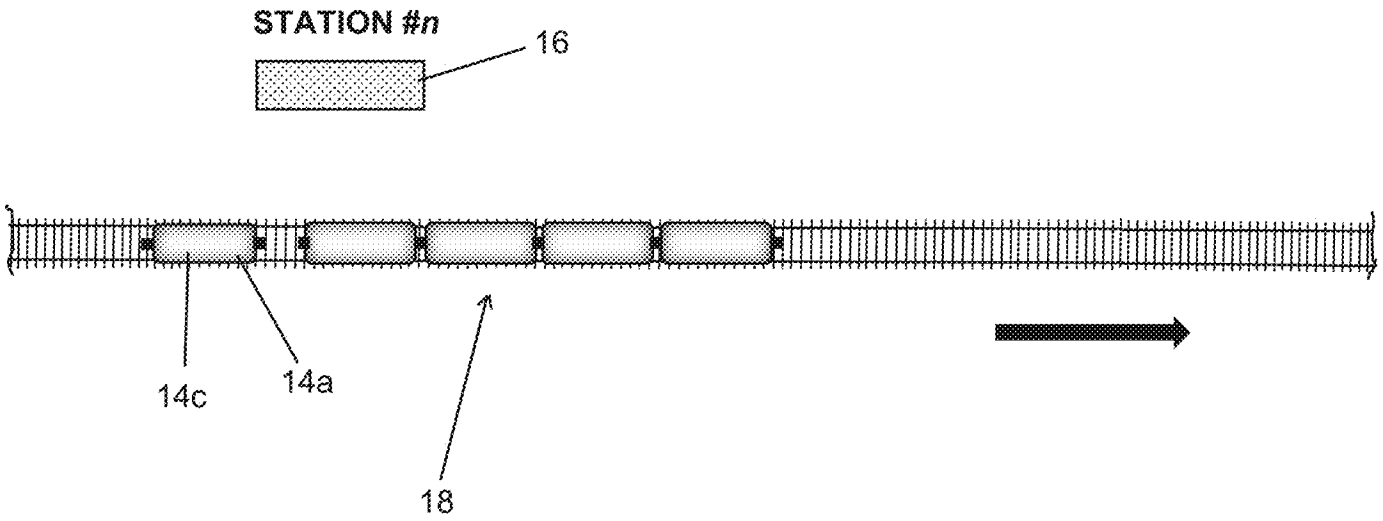
FIG. 10 is a schematic diagram in plan view of an embodiment of the present invention illustrating the rear car of the express train decoupling from the express train and stopping at the station or stop that the non-stop express train is in the process of passing.

FIG. 10 depicts a drop off car 14*c* that has decoupled from the express train 18 to stop at the station 16 or stop that the non-stop express train 18 is in the process of passing. The coupling proximity sensor suite system and associated displays, previously described, are also used for the decoupling operation of the drop off car(s) 14*c* from the non-stop express train 18 while underway. The coupling system operational status, confirmation of successful decoupling and any error or error messages and corrective action requirements are of a similar nature as those displayed during the coupling operation at the front of the non-stop express train 18. The embodiment of the display includes braking instructions and braking operational status for fully manual operation, partial computer-controlled operation or fully automated operation of the detaching car. In a further embodiment, the use of regenerative braking to charge associated batteries, super-capacitors or any other type of energy recovery system, such as hydraulic accumulators may be incorporated. The detached, self-propelled drop off train car(s) 14*c* slows and stops at the designated station 16 or stop and is now a prepositioned car 14*a* that disembarks the current load of passengers and waits for new passengers to embark prior to the expected arrival of the non-stop express train 18.

Figure 11:
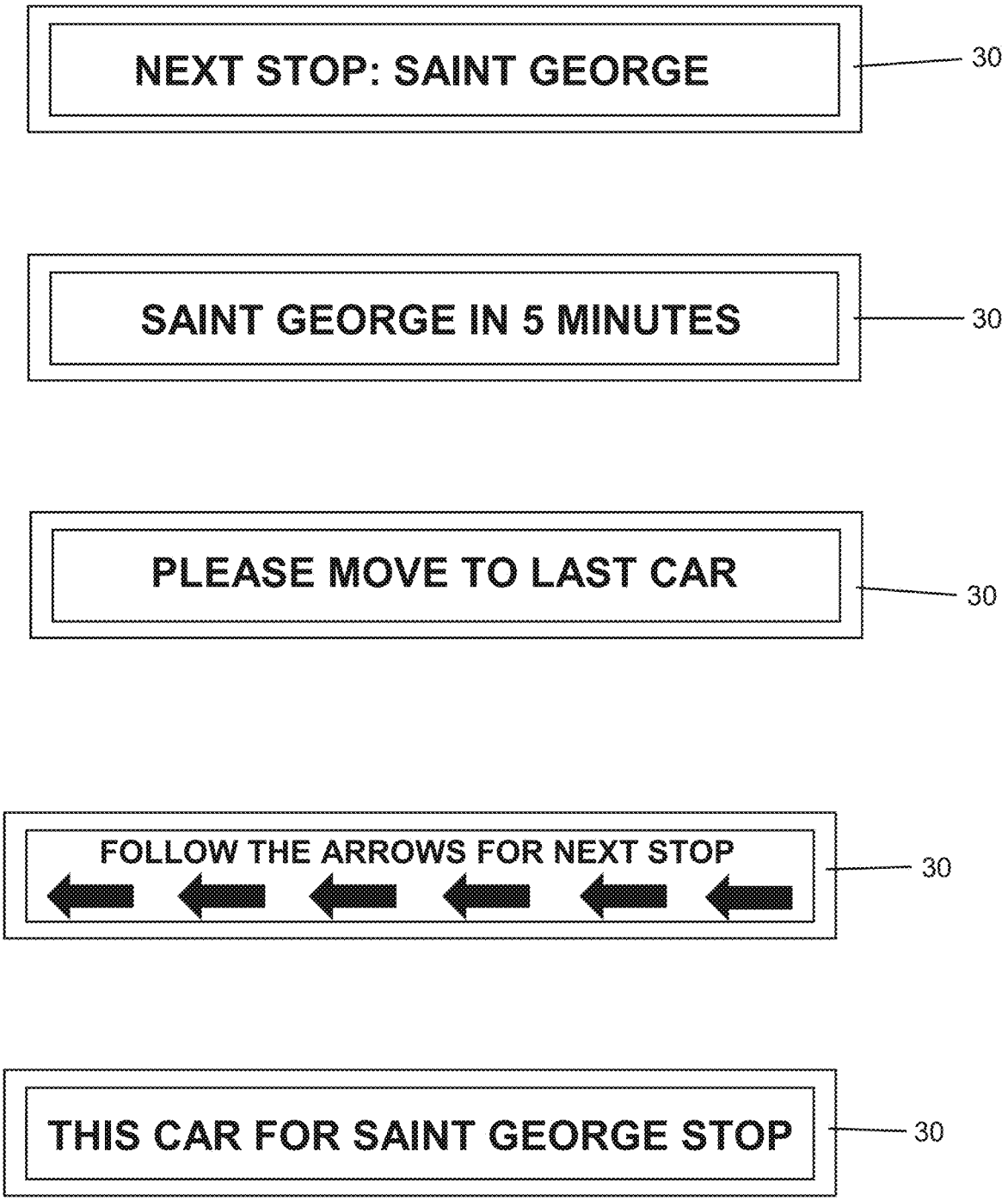
FIG. 11 is an illustration of exemplary visual aids onboard the express train to inform passengers to move to the last car of the express train in order to disembark at the stop now being passed.

FIG. 11 depicts the various visual aids 30 that are part of this embodiment on board the express train to inform passengers about the next stop and which provide instructions for the passengers to move to the drop off car or cars of the non-stop express train in order to disembark at the next stop. These visual aids 30 are graphic displays for the name of the station or stop coming up, the amount of time left prior to arrival at the stop and when to start moving to the drop off car or cars. The visual aids 30 may also include direction arrows that sweep across the display to indicate to the passengers which direction to go in order to get to the correct train car or cars for departure. These direction arrows are displayed in every car in the non-stop express train and efficiently and clearly guide each passenger to the correct car or cars to ensure that the passengers are in the correct car for their stop. The car or cars intended to detach have their visual aids 30 indicating to the departing passengers that they are in the correct car or cars. There are accompanying audible announcements from a speaker system, updates and instructions the passengers in conjunction with the visual aids 30 to assist during the departure phase. The visual and audible components of this embodiment may be simple devices or instructions that can be either supplemental devices to the existing car display systems or, depending on the pre-existing equipment in these cars, can be retrofitted into the existing display system.

Figure 12:
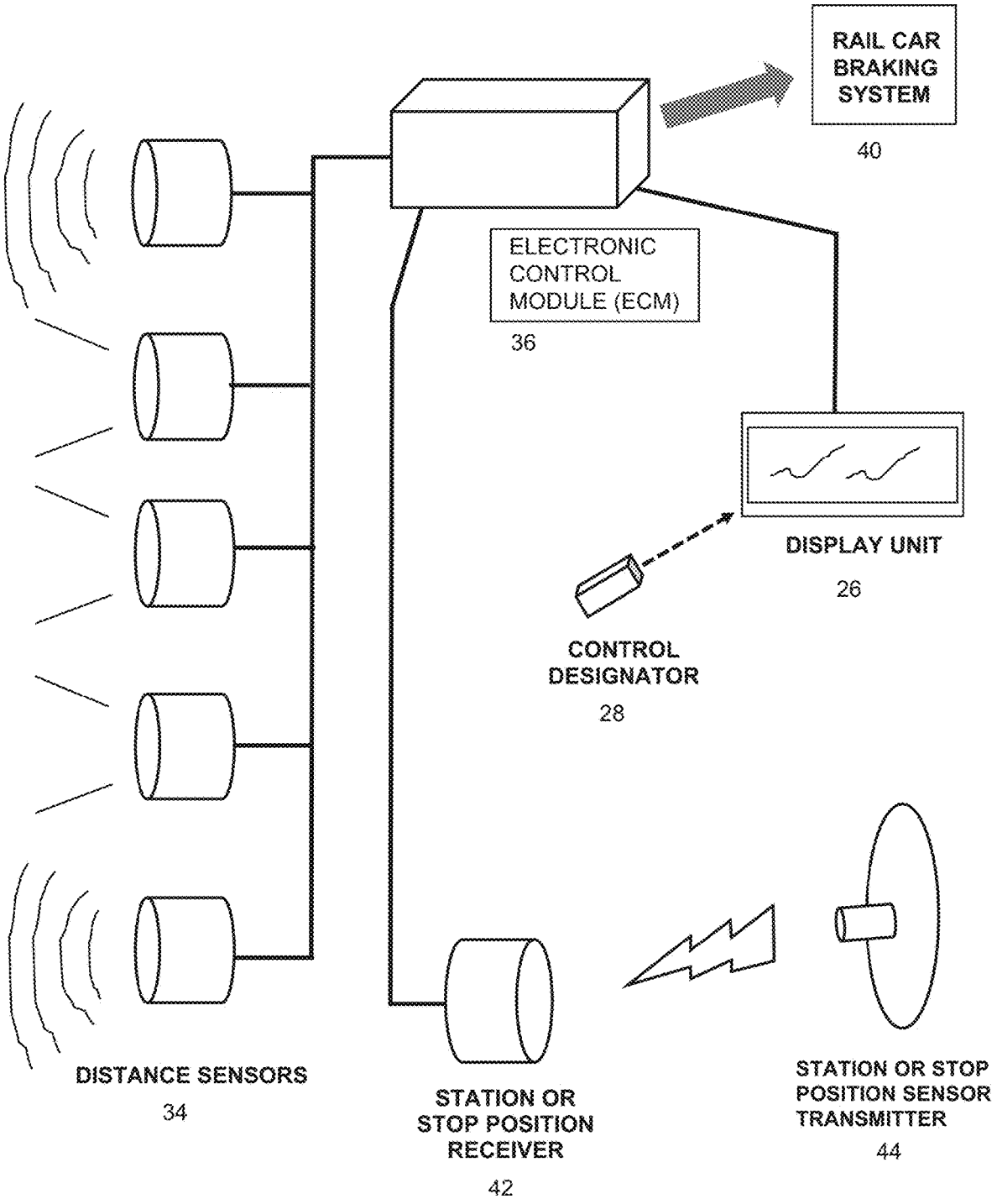
FIG. 12 is a block diagram of an embodiment of the present invention illustrating a proximity sensor suite system used to monitor and control the coupling operations of the railcars while underway.

FIG. 12 is a depiction of the block diagram of the added coupling proximity sensor suite system used to monitor and control the coupling operations of the railcars while underway. The embodiment of this device is composed of the following components:

- Distance sensors 34 using various mediums such as radio frequency (radar), sound (sonar or ultrasonic frequencies), visual (cameras or digital computer graphics or computer-generated images (CGI)) or any combination of these devices, or any similar means to provide accurate distance and relative speed information for fully manual, partially computer-controlled or fully automated coupling and uncoupling operations.
- In-cab coupling proximity sensor suite system display 26 provides the train operators system status, coupling sensors or switches, speeds, operational instructions, any information or error or warning messages that require corrective action and what that corrective action is for both the coupling and uncoupling operations. The coupling proximity sensor suite system display 26 also includes the camera or CGI views of the couplings showing the distance and relative alignment between the approaching car coupling and the coupling of the leading car. The display 26 provides real-time targeting information for the operator to monitor using CGI techniques to ensure safe and smooth coupling and decoupling operations regardless of whether the coupling or decoupling operations are either manually or computer controlled.
- The coupling proximity sensor suite system electronic control module or ECM 36 uses a central processor unit (CPU) device to receive the inputs from the various sensors, process those inputs and output the appropriate instructions, information, real-time visual, CGI and graphical representations of the coupling equipment status, or provide error messages with the necessary corrective actions required to ensure safe and secure coupling and uncoupling operations. The ECM 36 may also require that a control designator 28 such as the master key, master token, master code card or other similar device be the correct one and is properly inserted in the coupling proximity sensor suite system display 26 in order to properly operate the system for safe coupling and uncoupling of the cars.
- Interface with the existing braking system 40 or regenerative braking system to ensure safe and smoothly controlled braking of the detached car such that the car is accurately positioned to come to a stop at the correct location at the designated stop. A position transmitter 44 is permanently installed at each station or stop along the route that transmits a signal to a receiver 42 on each train car that is part of the coupling proximity sensor suite system. That receiver 42 sends the signal as an input to the coupling proximity sensor suite system ECM 36. The ECM 36 then provides the operator of the detached car real-time car-to-station distance information on the display device 26 from the position transmitter 44 in order for the operator to know when to start braking the detached car and to arrive at the correct location at the drop off or pick up location.

Figure 13:
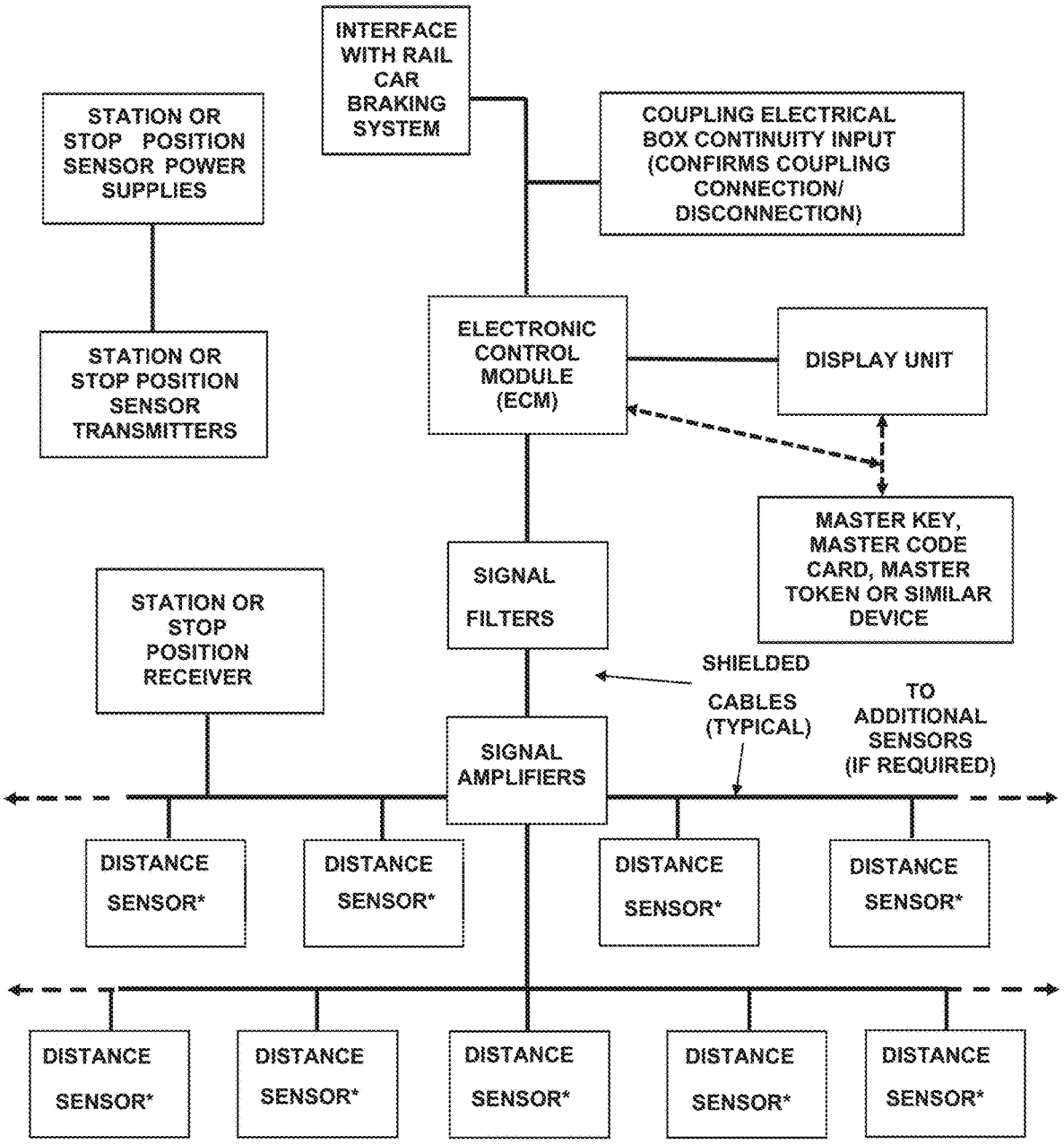
FIG. 13 a block diagram of an embodiment of the present invention illustrating a proximity sensor suite system.

FIG. 13 depicts the line diagram of the added instrumentation and controls for the coupling proximity sensor suite system previously described as part of this embodiment. The entire coupling proximity sensor suite system is anticipated to be a self-contained, pre-assembled module consisting of sensors, receivers, wiring, ECM and display that is easily retrofitted to existing train cars or easily incorporated during fabrication of new train cars. However, the embodiment also includes the suite as individual components that can be incorporated piecemeal. The added coupling proximity sensor suite system wiring connection between each train car is anticipated to be incorporated into the electronics and power box located above each Scharfenberg coupling that is used on virtually all rapid transit train cars.

Figure 14:
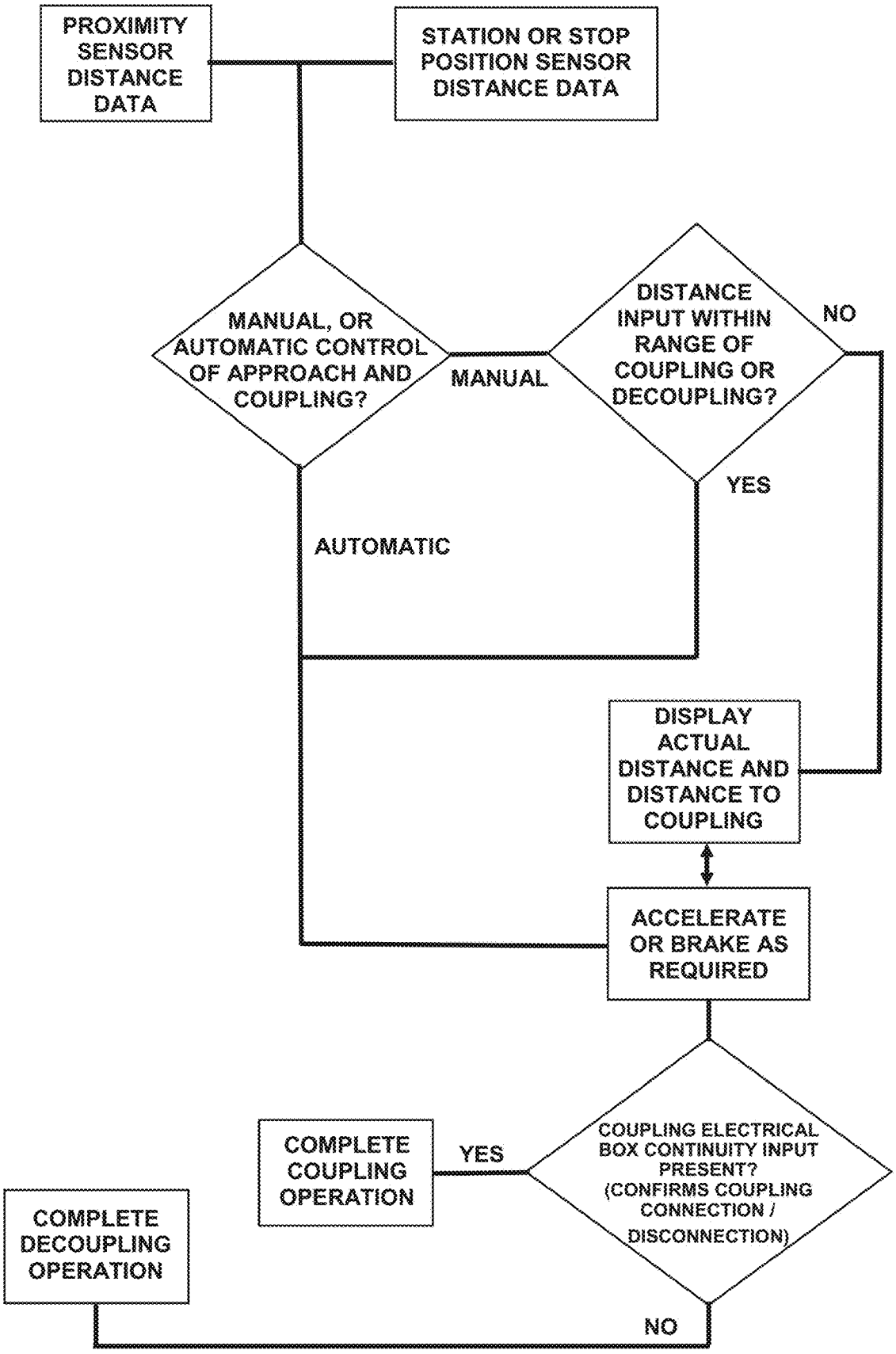
FIG. 14 a block diagram of an embodiment of the present invention illustrating a proximity sensor suite system.

FIG. 14 depicts the coupling proximity sensor suite system logic diagram. The logic diagram is only a basic representation of the decision logic based on the various inputs, variances from the expected input signals, output signals, graphical and visual interfaces, warnings, errors and corrective actions. The system display is haptic based and is heavily graphically and visually based in order to provide the operator with simple, clear and user-friendly information, instructions, warnings, error and corrective action messages. As described in FIG. 12, the system ECM receives input signals from the proximity sensors and position transmitters. These sensors are located at each end of the train car since the car can be coupled or decoupled at either end in this embodiment. The ECM also receives an input signal from fixed transmitters along the route for enabling detached cars to brake and stop at each station or stop. The logic of the system is designed to provide visual instructions, visual information from the cameras and sensors, along with audible and graphical illustrations, graphical notifications, warnings, error messages and the proper corrective action (s). This is all incorporated into the CPU software and an additional feature of this embodiment is that such software can be automatically or manually updated via wireless transmissions from a central service provider when required without disrupting the normal operation of the system.

Figure 15:
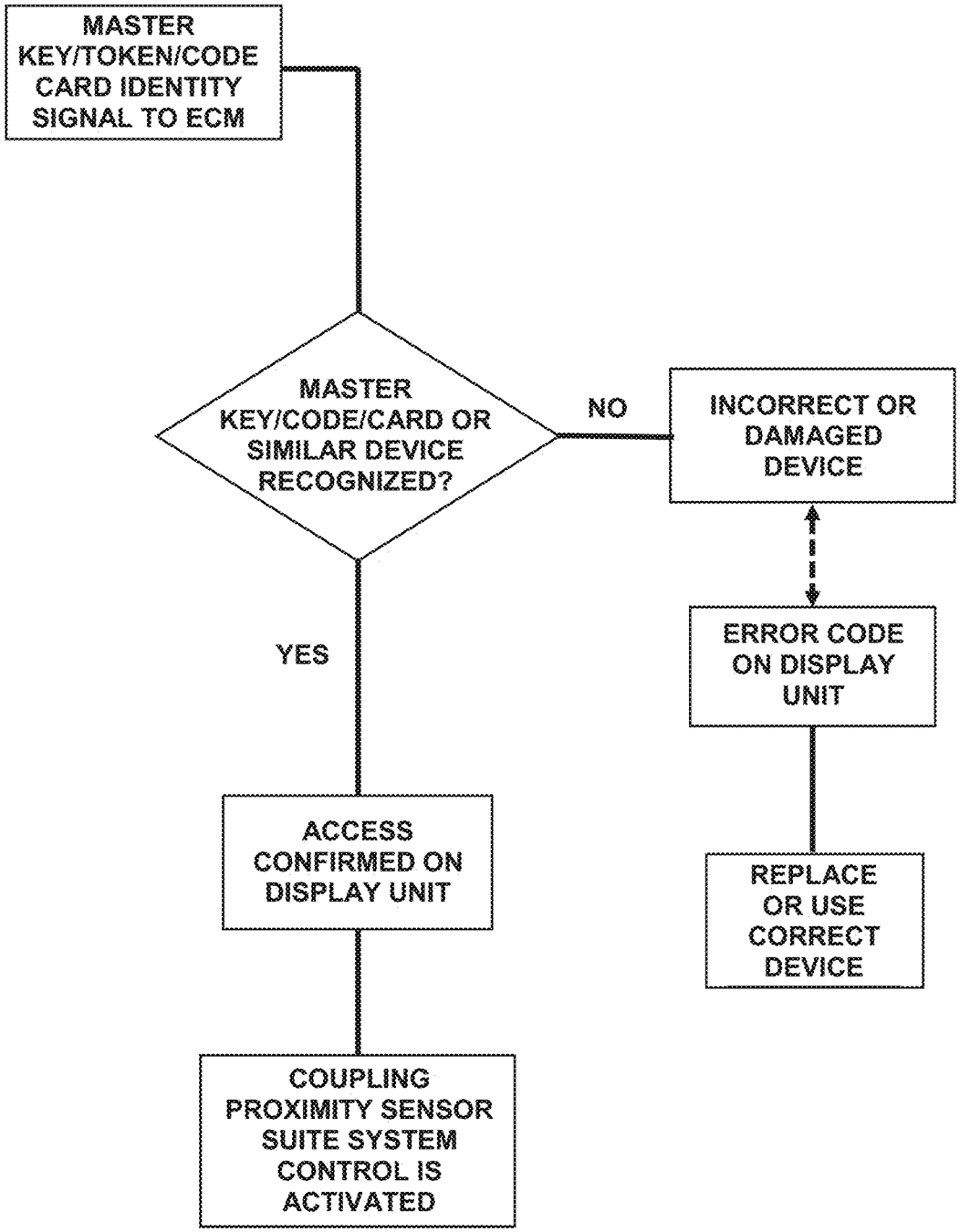
FIG. 15 a block diagram of an embodiment of the present invention illustrating a proximity sensor suite system.

FIG. 15 depicts a simple logic diagram of the master operating key, master token or master code card that is used as part of this embodiment to initiate operation of the system, transfer operating control to other cars and discontinue operation of the coupling proximity sensor suite system and hence, to provide master control of the non-stop express trains and the individual prepositioned cars. This embodiment covers the use of rolling codes, fixed codes, bar coded, Radio Frequency Identification (RFI) technology or other similar digital device or devices that interface with a corresponding compatible device or devices in the proximity sensor suite system that securely reads the digital codes, confirms correct identity and authorizes user interface and subsequent system operation.

The present invention may further include additional amenities that are included in this embodiment and are proposed for enhancing the express train experience for passengers. These amenities include, but are not limited to, toilet and washroom facilities, food and non-alcoholic beverage kiosks or set-ups and wireless internet and music access.

The embodiments of this invention as described herein are designed to cost-effectively improve the operation of rapid transit systems through the use of non-stop express trains that never have to stop at any station or stop along the route to embark or disembark passengers. This train runs continuously from one end of the route to the other thereby providing passengers with the fastest transit possible. The prepositioned cars that are part of this embodiment are used to make the intermediate stops and, as a further aspect of this embodiment, these prepositioned cars take the place of fixed stations and are designed to stop anywhere along the route while acting as the station when stationary at that stop prior to leaving ahead of the approaching non-stop express train. In a further embodiment, the coupling proximity sensor suite system enables the safe, smooth and efficient operation of the coupling and decoupling evolutions of the non-stop express trains and the leading and trailing train cars that attach and separate from the express train at each predetermined stop along the route. The invention is further enhanced by the embodiment of the ability to selectively incorporate some or all of the features of this invention depending on budgetary constraints and existing system infrastructure and operating restraints. The embodiment of the coupling proximity sensor suite system that makes this invention possible is further enhanced by it being envisioned as either modular or non-modular in configuration. This aspect of the coupling proximity sensor suite system is another cost-effective approach of this invention, such that existing or new construction train cars can be efficiently outfitted with this system with minimal impact to the budget and can be easily coordinated for installation with the existing rail car maintenance or new car construction schedule.

It should be understood, of course, that the foregoing relates to exemplary embodiments of the invention and that modifications may be made without departing from the spirit and scope of the invention as set forth in the following claims.

What is claimed is:

1. A non-stop train system comprising:

a plurality of train cars each comprising:

a braking system coupled to rail wheels;

an operators cab comprising controllers;

a display disposed within the operator's cab;

a front coupler and a rear coupler;

a proximity sensor; and a wireless transmitter and receiver;

an electronic control module communicatively coupled to the proximity sensor and the display via the wireless transmitter and receiver, and comprising a processor and a memory, and a track comprising a plurality of drop off and pick up locations, wherein at least one prepositioned train car of the plurality of train cars is stopped on the track at one of the plurality drop off and pick up locations, at least one non-stop express train car of the plurality of train cars approaches the one of the plurality drop off and pick up locations on the track initiating the at least one prepositioned train car to begin departure from the one of the plurality drop off and pick up locations, the proximity sensors detect a distance and a relative speed between the at least one non-stop express train car and the at least one prepositioned train car, and the electronic control module processes inputs of the proximity sensors and outputs data comprising the distance and the relative speed between the at least one non-stop express train car and the at least one prepositioned train car on the display to facilitate manual coupling, automated coupling, or a combination thereof of the front coupler of the at least one non-stop express train car to the rear coupler of the at least one prepositioned train car while moving along the track.

2. The non-stop train system of claim 1, wherein at least one drop off train car decouples from the at least one non-stop express train car, and the braking system of the at least one drop off train car activates to stop at the one of the plurality of drop off and pick up locations.

3. The non-stop train system of claim 2, wherein the display of the drop off train displays braking instructions and a braking operational status.

4. The non-stop train system of claim 2, wherein each of the plurality of train cars comprise at least one of a speaker and a visual aid configured to communicate instructions to passengers.

5. The non-stop train system of claim 4, wherein the visual aids are graphic displays that display a name of an upcoming drop off and pick up location, an amount of time left prior to arrival at the upcoming drop off and pick up location, and when to start moving to the drop off car.

6. The non-stop train system of claim 1, wherein the plurality of drop off and pick up locations comprises a combination of stations and designated stops along the track.

7. The non-stop train system of claim 1, wherein the electronic control module further outputs the data on the display comprising: a status of the coupling operation, a status of the control transfer of train cars, and a confirmation that the train cars are properly connected together or an error message that provides instructions required to correct the coupling operation.

8. The non-stop train system of claim 1, wherein a distance and a time of arrival of the at least one non-stop express train that is approaching from behind the at least one prepositioned car is displayed on the display.

9. The non-stop train system of claim 1, wherein the front couplers and the rear couplers are Scharfenberg-type couplers.

10. The non-stop train system of claim 1, wherein the electronic control module adjusts a speed differential of the at least one non-stop express train and the at least one prepositioned car to be between about 0.37 miles per hour up to about 22 miles per hour.

11. The non-stop train system of claim 1, wherein the proximity sensors further detect an alignment between the front coupler of the at least one non-stop express train car and rear coupler of the at least one prepositioned train car, wherein a status of the alignment is displayed on the display.

12. The non-stop train system of claim 1, wherein the proximity sensors comprise at least one of a radio frequency sensor, a sonar sensor, an ultrasonic frequency sensor, and a camera.

13. The non-stop train system of claim 12, wherein a real-time visual or graphical representations of the couplers are displayed on the display.

14. The non-stop train system of claim 1, wherein the electronic control module designates a control car to control the train via a control designator, wherein the control designator is transferred from the at least one non-stop express train car to the prepositioned train car when the prepositioned train car is coupled to the at least one non-stop express train car, wherein the control designator is at least one of a master key, a master token, a master code, and a master computer readable code.

* * * * *